US012546211B2

(12) United States Patent
Deffenbaugh et al.

(10) Patent No.: US 12,546,211 B2
(45) **Date of Patent: *Feb. 10, 2026**

(54) METHOD AND DEVICE FOR OBTAINING MEASUREMENTS OF DOWNHOLE PROPERTIES IN A SUBTERRANEAN WELL

(71) Applicant: SAUDI ARABIAN OIL COMPANY, Dhahran (SA)

(72) Inventors: Max Deffenbaugh, Houston, TX (US); Gregory Ham, Houston, TX (US); Jose Oliverio Alvarez, Houston, TX (US); Gregory Bernero, Houston, TX (US); Sunder Ramachandran, Sugarland, TX (US); Miguel Gonzalez, Houston, TX (US); Huseyin Seren, Houston, TX (US); Sebastian Csutak, Houston, TX (US); Christopher Powell, Houston, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 18/768,427

(22) Filed: Jul. 10, 2024

(65) Prior Publication Data

US 2024/0360757 A1 Oct. 31, 2024

Related U.S. Application Data

(60) Continuation of application No. 18/167,492, filed on Feb. 10, 2023, now Pat. No. 12,055,036, which is a (Continued)

(51) Int. Cl.
*E21B 47/12* (2012.01)
*E21B 23/10* (2006.01)

(Continued)

(52) U.S. Cl.
CPC ..... *E21B 47/138* (2020.05); *E21B 23/10* (2013.01); *E21B 47/04* (2013.01); *E21B 47/06* (2013.01);

(Continued)

(58) Field of Classification Search
CPC ..... E21B 47/138; E21B 47/26; E21B 47/07; E21B 47/095; E21B 47/135;

(Continued)

(56) References Cited

U.S. PATENT DOCUMENTS 5,515,924 A * 5/1996 Osterhoudt, III ..... C09K 8/94 166/309
7,819,189 B1 * 10/2010 Cosby ..... E21B 43/121 166/250.01

(Continued)

*Primary Examiner* — George S Gray
(74) *Attorney, Agent, or Firm* — Osha Bergman Watanabe & Burton LLP

(57) ABSTRACT

An untethered apparatus for measuring properties along a subterranean well includes a housing and one or more sensors configured to measure data along the subterranean well. The data includes one or more physical, chemical, geological or structural properties in the subterranean well. The untethered apparatus further includes a processor configured to control the one or more sensors measuring the data and to store the measured data, and a transmitter configured to transmit the measured data to a receiver arranged external to the subterranean well. Further, the untethered apparatus includes a controller configured to control the buoyancy or the drag of the untethered apparatus to control a position of the untethered apparatus in the subterranean well. The processor includes instructions defining measurement parameters for the one or more sensors of the untethered apparatus within the subterranean well.

16 Claims, 4 Drawing Sheets

Related U.S. Application Data continuation of application No. 17/127,169, filed on Dec. 18, 2020, now Pat. No. 11,578,590, which is a continuation of application No. 16/509,126, filed on Jul. 11, 2019, now Pat. No. 10,900,351, which is a division of application No. 15/143,128, filed on Apr. 29, 2016, now abandoned.

(60) Provisional application No. 62/155,219, filed on Apr. 30, 2015.

(51) Int. Cl.

| | |
|---|---|
| ***E21B 47/04*** | (2012.01) |
| ***E21B 47/06*** | (2012.01) |
| ***E21B 47/07*** | (2012.01) |
| ***E21B 47/09*** | (2012.01) |
| ***E21B 47/10*** | (2012.01) |
| ***E21B 47/113*** | (2012.01) |
| ***E21B 47/135*** | (2012.01) |
| ***E21B 47/26*** | (2012.01) |

(52) U.S. Cl.

CPC ..... *E21B 47/09* (2013.01); *E21B 47/12* (2013.01); *E21B 47/26* (2020.05); *E21B 47/07* (2020.05); *E21B 47/10* (2013.01); *E21B 47/113* (2020.05); *E21B 47/114* (2020.05); *E21B 47/135* (2020.05)

(58) Field of Classification Search

CPC ..... E21B 47/113; E21B 47/114; E21B 47/06; E21B 47/09; E21B 47/04; E21B 47/12; E21B 47/10; E21B 47/13; E21B 23/10; G05B 19/406; G05B 2219/36292

See application file for complete search history.

(56) References Cited

U.S. PATENT DOCUMENTS

| | | | | |
|---|---|---|---|---|
| 2005/0241825 | A1* | 11/2005 | Burris, II | E21B 43/119 166/120 |
| 2006/0157239 | A1* | 7/2006 | Ramos | E21B 47/135 166/254.2 |
| 2009/0126938 | A1* | 5/2009 | White | E21B 33/0353 166/368 |
| 2011/0253373 | A1* | 10/2011 | Kumar | E21B 49/084 166/306 |

* cited by examiner

METHOD AND DEVICE FOR OBTAINING MEASUREMENTS OF DOWNHOLE PROPERTIES IN A SUBTERRANEAN WELL

CROSS REFERENCE TO RELATED APPLICATIONS

This application is a continuation of and claims the benefit of priority to U.S. patent application Ser. No. 18/167,492, filed on Feb. 10, 2023, entitled, "METHOD AND DEVICE FOR OBTAINING MEASUREMENTS OF DOWNHOLE PROPERTIES IN A SUBTERRANEAN WELL," which is a continuation application of U.S. patent application Ser. No. 17/127,169, filed on Dec. 18, 2020, entitled, "METHOD AND DEVICE FOR OBTAINING MEASUREMENTS OF DOWNHOLE PROPERTIES IN A SUBTERRANEAN WELL," which is a continuation application of U.S. patent application Ser. No. 16/509,126, filed on Jul. 11, 2019, entitled, "METHOD AND DEVICE FOR OBTAINING MEASUREMENTS OF DOWNHOLE PROPERTIES IN A SUBTERRANEAN WELL," which is a divisional application of U.S. patent application Ser. No. 15/143,128, filed on Apr. 29, 2016, entitled, "METHOD AND DEVICE FOR OBTAINING MEASUREMENTS OF DOWNHOLE PROPERTIES IN A SUBTERRANEAN WELL," which claims the benefit of and priority to U.S. Provisional Patent Application Ser. No. 62/155,219, filed on Apr. 30, 2015, entitled, "METHOD AND DEVICE FOR OBTAINING MEASUREMENTS OF DOWNHOLE PROPERTIES IN A SUBTERRANEAN WELL"; the disclosures of which are hereby incorporated by reference in their entireties into this application.

BACKGROUND

Field of the Invention

Embodiments of the present invention generally relate to a method and device for obtaining measurements of downhole properties along a subterranean well. More particularly, embodiments of the present invention relate to an untethered, buoyancy-controlled and/or drag-controlled device and a method of use of the device for measuring physical, chemical, geological, and structural properties along a well.

Description of the Related Art

Measurement of downhole properties along a subterranean well is critical to the drilling, completion, operation, and abandonment of wells. These wells may be used for recovering hydrocarbons from subsurface reservoirs, injecting fluids into subsurface reservoirs, and monitoring the conditions of subsurface reservoirs.

The downhole properties relate to the physical, chemical, geological, and structural properties along the wellbore at various stages in the life of the well. For example, the downhole properties include, but are not limited to, pressure, differential pressure, temperature, "water cut", which is a percentage of water or brine present in downhole fluids, volume fractions of oil, brine, or gas in downhole fluids, levels/locations of/depths to the dew point for gas condensate, liquid condensate, oil, or brine along the well, flow rate of oil, brine, or gas phases, inflow rate of the oil, brine, or gas into the well from surrounding rock formations, the density or viscosity of drilling mud and the depth of invasion of the drilling mud into surrounding rock formations, the thickness or consistency, or degree of coverage of mudcake that may remain on the borehole wall, the chemical composition of the water or brine mixture, the chemical composition of the hydrocarbons, the physical properties of the downhole fluids, including, for example, density or viscosity, the multiphase flow regime, the optical properties of the hydrocarbons or brine such as turbidity, absorption, refractive index, or fluorescence, fluorescing tracers, the amount of or type of corrosion or scale on the casing or production tubing, the rate of corrosion or scale growth, the presence or absence or concentration of corrosion inhibitor or scale inhibitor chemicals that might be added to the well, the open cross-section within the production tubing or borehole which would conventionally be measured by calipers, the acoustical or clastic properties of the surrounding rock, which may be isotropic or anisotropic, the electrical properties of the surrounding rock, including, for example, the surrounding rock's resistive or dielectric properties, which may be isotropic or anisotropic, the density of the surrounding rock, the presence or absence of fractures in the surrounding rock and the abundance, orientation, and aperture of these fractures, the total porosity or types of porosity in the surrounding rock and the abundance of each pore type, the mineral composition of the surrounding rock, the size of grains or distribution of grain sizes and shapes in the surrounding rock, the size of pores or distribution of pore sizes and shapes in the surrounding rock, the absolute permeability of the surrounding rock, the relative permeability of the surrounding rock, the wetting properties of fluids in the surrounding rock, contact angles of the fluids on a surface, and the surface tension of fluid interfaces along the well or in the surrounding rock. These properties are conventionally measured as a function of (or as they vary with) depth or linear distance along the well, or as they vary with another property such as time since deployment of the measurement tool or with pressure as a surrogate for depth.

Downhole properties along a well are measured conventionally using tethered logging tools, which are suspended on a cable, and lowered into the wellbore using, for example, a winch mounted in a logging truck and a crane. In some cases, the conventional tethered logging tools are pushed into the wellbore using, for example, coiled tubing, or pushed or pulled along the wellbore using a tractor, or other similar driving mechanism. Conventional tethered logging tools and the cable or wiring attached thereto are generally bulky, requiring specialized vehicles or equipment and a specialized crew of technicians to deploy and operate. The need to mobilize specialized vehicles and/or other large equipment and to provide a crew of technicians to remote well sites increases the expense associated with well logging and can introduce undesirable delays in obtaining needed data.

Another conventional method for acquiring downhole data uses fiber optic cables, which function as sensor strings, or wired networks of downhole sensors. These fiber optic cables and wired networks are deployed along a well to provide data collection over a longer period of time than is practical with wireline tools. Recorded data from these sensors is generally limited, however, to temperature, pressure or strain, and acoustic data. The cost of deploying such a network of wired measurement devices can be significant, and well operation must be stopped and taken off-line to deploy the long downhole cables.

Accordingly, there is a need for a small, untethered downhole sensor and method of use for measuring downhole properties along a well, which can be deployed by a single individual, preferably a non-specialist technician in the field, without the need for mobilizing specialized logging crews, vehicles, or equipment. There is also a need for well logging using an untethered downhole sensor, which can be deployed along a wellbore, without the need for taking the well off-line and stopping production within the well, killing the well, or installing a blow-out preventer (BOP) and lubricator system for controlling pressure along the well, while logging. There is also a need for an untethered, downhole sensor that can carry a wide variety of sensors to measure the physical, chemical, geological, and structural properties along a well, which can be deployed at a small fraction of the cost associated with a conventional tethered downhole sensor.

SUMMARY

In conventional tethered logging tools, the position of the tool along the well is controlled by the length of the tether, whether slickline cable, wireline cable, coiled tubing, or other tether, which suspends, pulls, or pushes the tool along the well. In contrast, the position of an untethered tool or device, according to various embodiments of the invention, along the well is controlled by the forces that the downhole fluids exert on the tool or device. Among these forces are buoyancy and drag. Buoyancy is the force generated by the difference in density between the device and the surrounding fluid (whether liquid or gas or a mixture thereof). This force causes the device to accelerate upward (to ascend) when surrounded by a heavier fluid and to accelerate downward (to descend) when surrounded by a lighter fluid.

The drag force is the force generated by the difference in velocity between the device and the surrounding fluid (whether liquid or gas or a mixture thereof). The drag force works to accelerate or decelerate a device to match the velocity of the surrounding fluid. The drag force depends on the shape of the device, a factor captured by the drag coefficient, and the size of the device, a factor captured by the reference area, which is a measure of the profile that the device presents to the flow. The drag force also depends on the difference between the velocity of the device and the velocity of the surrounding fluid. A device with large drag will tend to move with the surrounding fluid, while a device with small drag will have a greater ability to move against the surrounding fluid, (i.e., to move faster or slower than the surrounding fluid.)

Embodiments of the invention provide that the location of an untethered device along a well can be controlled by adjusting the buoyancy of the device. Embodiments further provide that when there is fluid flow within the well (such as when drilling mud is circulating during the drilling of the well, or when fracturing fluid is being pushed into the well during hydraulic fracturing, or when hydrocarbons are being produced out of the well), the location of the untethered device can be controlled by adjusting the drag of the device. Embodiments further provide that it requires far less stored energy inside the device to move by adjusting buoyancy and drag than to move using wheels, legs, or propellers. Thus, a buoyancy-controlled and/or drag-controlled device, according to various embodiments of the invention, can be smaller and less expensive than one which uses wheels, legs, or propellers for locomotion, as used in the conventional art.

Accordingly, embodiments of the invention have been made to provide an untethered, buoyancy-controlled and/or drag-controlled device configured to measure one or more physical, chemical, geological, or structural properties along a well.

In operation, the untethered, buoyancy-controlled and/or drag-controlled device, according to at least one embodiment, is deployed and recovered at a top surface of a subterranean well. According to the various embodiments of the invention described below, the top surface of the well refers to a position near the surface of the earth, the well head, or the top of the liquid within the well, which may be some distance below the surface of the earth.

According to the various embodiments of the invention described below, the device is untethered, and therefore has no cable, wireline, slickline, rope, string, fiber, wire, or coiled tubing attaching the device to the surface from the time the device is deployed until it is recovered from the wellbore. Various embodiments of the invention, as discussed herein, provide no solid connection from the surface to the one or more sensors provided on the device, which provides power or communication, or causes the device to move from the time it is deployed until it returns to the top surface of the well. According to at least one embodiment, the device may attach to one or more objects in the well in order to remain stationary, but when the device moves, it is not attached to anything. According to at least one embodiment, the device may also attach to or be grabbed by a tether or another solid object during deployment or recovery at the top surface of the well.

Subterranean wells follow a trajectory in a 3-dimensional space, which may, for example, be expressed as a curve, which intersects certain (x,y,z) points or casting, northing, and depth (or elevation) points. This trajectory is carefully measured and determined at the time the well is drilled, and from which the location of a downhole measurement may be determined by associating that measurement with a distance along the trajectory of the well. For tethered measurement devices, such as slickline, wireline, and coiled tubing deployed devices, the length of the tether provides a primary measurement of the distances along the trajectory of the well where the measurements are taken. The (x,y,z) coordinates of the measurements in the subsurface are then determined by the (x,y,z) coordinates of the trajectory of the well at a distance along the well that equals the length of the tether. For untethered devices, the wellbore or the casing or tubing within the wellbore will exert forces on the untethered device as it travels along the well, such that the untethered device follows the trajectory of the well bore and measurements made by the untethered device are made at locations along the trajectory of the well. However, there is no tether length which can be measured at the surface to determine where along the trajectory of the well the untethered measurements were taken. Accordingly, for untethered devices, some property other than tether length must be measured and used in conjunction with the known trajectory of the well to determine the location of the measurements in the subsurface.

Embodiments of the invention, as recited in the pending claims, provide non-obvious advantages over conventional tethered well logging tools, including, for example, obtaining measurements of downhole properties in a well with fewer logistical and operational delays and at a much lower cost than conventional tools and methods.

According to at least one embodiment, there is provided an untethered apparatus for measuring properties along a subterranean well, whereby the untethered apparatus includes a housing, and one or more sensors configured to measure data along the subterranean well. The data includes one or more physical, chemical, geological, or structural properties along the subterranean well. The untethered apparatus further includes a processor configured to read the one or more sensors measuring the data and to store the measured data, and a transmitter configured to transmit the measured data to a receiver arranged external to the subterranean well. Further, the untethered apparatus includes a controller configured to control at least one of a buoyancy and a drag of the untethered apparatus to control a position of the untethered apparatus along the subterranean well.

According to at least one embodiment, the one or more processors include instructions defining measurement parameters for the one or more sensors of the untethered apparatus within the subterranean well.

According to at least one embodiment, the one or more sensors includes a position sensor configured to measure a pressure acting on the untethered device to determine a location at which the untethered device is positioned along the subterranean well.

According to at least one embodiment, the one or more sensors includes a position sensor configured to calculate an amount of time that the untethered apparatus has been moving since a last position along the subterranean well to determine a location at which the untethered device is positioned along the subterranean well. In at least one embodiment, the position sensor includes a calculation of elapsed time and a calculation of the untethered device speed along the subterranean well utilizing a dimension, such as a diameter of the untethered device, a density of the untethered device and a density of the fluid within the subterranean well, a flow rate of the fluid along the subterranean well, a trajectory of the subterranean well, and a dimension of the subterranean well, for example, its diameter.

According to at least one embodiment, the one or more sensors includes a position sensor including a casing or tubing collar detector configured to detect when the untethered apparatus passes a casing or tubing collar along the subterranean well and counts a number of the casing or tubing collars, which have been passed in the subterranean well, to determine a location at which the untethered device is positioned along the subterranean well.

According to at least one embodiment, the one or more sensors include a downhole property sensor configured to measure one or more downhole properties of the one or more downhole fluids in the subterranean well.

According to at least one embodiment, the controller includes an actuator configured to change at least one of a buoyancy and a drag of the untethered apparatus.

According to at least one embodiment, the actuator is configured to change the at least one of the buoyancy and the drag of the untethered apparatus, when the controller is activated by an electrical signal from the one or more processors.

According to at least one embodiment, the untethered apparatus further includes a weight, and a weight securing means for securing and releasing the weight to and from the untethered apparatus to change at least one of a buoyancy and a drag of the untethered apparatus.

According to at least one embodiment, the one or more sensors is configured to measure the data as the untethered apparatus descends and ascends within the subterranean well.

According to at least one embodiment, the controller includes at least one fin and a controlling means for deploying and retracting the at least one fin to increase and decrease, respectively, the drag of the untethered apparatus within a fluid flowing within the subterranean well.

According to another embodiment, there is provided a method for measuring properties along a subterranean well. The method includes the steps of programming a movement of an untethered device along a subterranean well, wherein a position of the untethered device along the subterranean well is controlled by changing at least one of: a buoyancy of the untethered device and a drag of the untethered device upon measuring data in the subterranean well, the data comprising one of one or more physical, chemical, or structural properties in the subterranean well or the dynamics or position of the device in the subterranean well, and releasing the programmed untethered device into the subterranean well, such that the untethered device descends into the subterranean well. The method further includes the steps of recovering the untethered device from the subterranean well after the untethered device changes at least one of: the buoyancy and the drag and ascends in the subterranean well, and measuring and recording the data in the subterranean well during at least one of the descent of the untethered device and the ascent of the untethered device in the subterranean well. Further, the method includes the steps of downloading the recorded data on an external processor, and determining, using a trajectory of the well, one or more locations of the untethered device at which the data was measured.

According to at least one embodiment, the subterranean well has a pressure at a well head which is in excess of a pressure outside the well head.

According to at least one embodiment, the subterranean well is a producing well which is producing fluids from downhole for at least part of the time while the untethered apparatus is in the subterranean well.

According to at least one embodiment, the subterranean well comprises a screen positioned in a flow of the produced fluids, in which the produced fluids pass the screen, but do not pass the untethered apparatus.

According to another embodiment, there is provided an untethered apparatus for measuring properties along a subterranean well. The untethered apparatus includes a housing, one or more sensors configured to measure data along the subterranean well, the data comprising one or more physical, chemical, or structural properties along the subterranean well, and one or more processors configured to control the one or more sensors measuring the data and to store the measured data, wherein each of the one or more processors comprises instructions defining measurement parameters for the one or more sensors of the untethered apparatus within the subterranean well. The untethered apparatus further includes a transmitter configured to transmit the measured data to a receiver arranged external to the subterranean well, and a controller configured to control a buoyancy of the untethered apparatus to control a position of the untethered apparatus along the subterranean well, wherein the controller comprises a weight attached to an exterior surface of the untethered apparatus, and a weight securing means for securing and releasing the weight to and from the exterior surface of the untethered apparatus to control the position of the untethered apparatus along the subterranean well. Further, the apparatus includes a non-transitory computer-readable medium in communication with the one or more processors having computer-readable instructions stored therein that when executed cause the untethered apparatus to perform various steps. For example, the steps include programming movement of the untethered device along the subterranean well, wherein the position of the untethered device along the subterranean well is controlled by changing the buoyancy of the untethered device upon measuring the data in the subterranean well, and releasing the programmed untethered device into the subterranean well, such that the untethered device descends into the subterranean well. Further, the steps include recovering the untethered device from the subterranean well after the untethered device changes its buoyancy and ascends in the subterranean well, and measuring and recording the data in the subterranean well during at least one of the descent of the untethered device and the ascent of the untethered device in the subterranean well. The steps further include downloading the recorded data on an external processor.

Various objects, advantages and features of the invention will become apparent from the following description of embodiments with reference to the accompanying drawings.

BRIEF DESCRIPTION OF DRAWINGS

These and other features, aspects, and advantages of the invention are better understood with regard to the following Detailed Description, appended Claims, and accompanying Figures. It is to be noted, however, that the Figures illustrate only various embodiments of the invention and are therefore not to be considered limiting of the invention's scope as it may include other effective embodiments as well.

DETAILED DESCRIPTION

Figure 1:
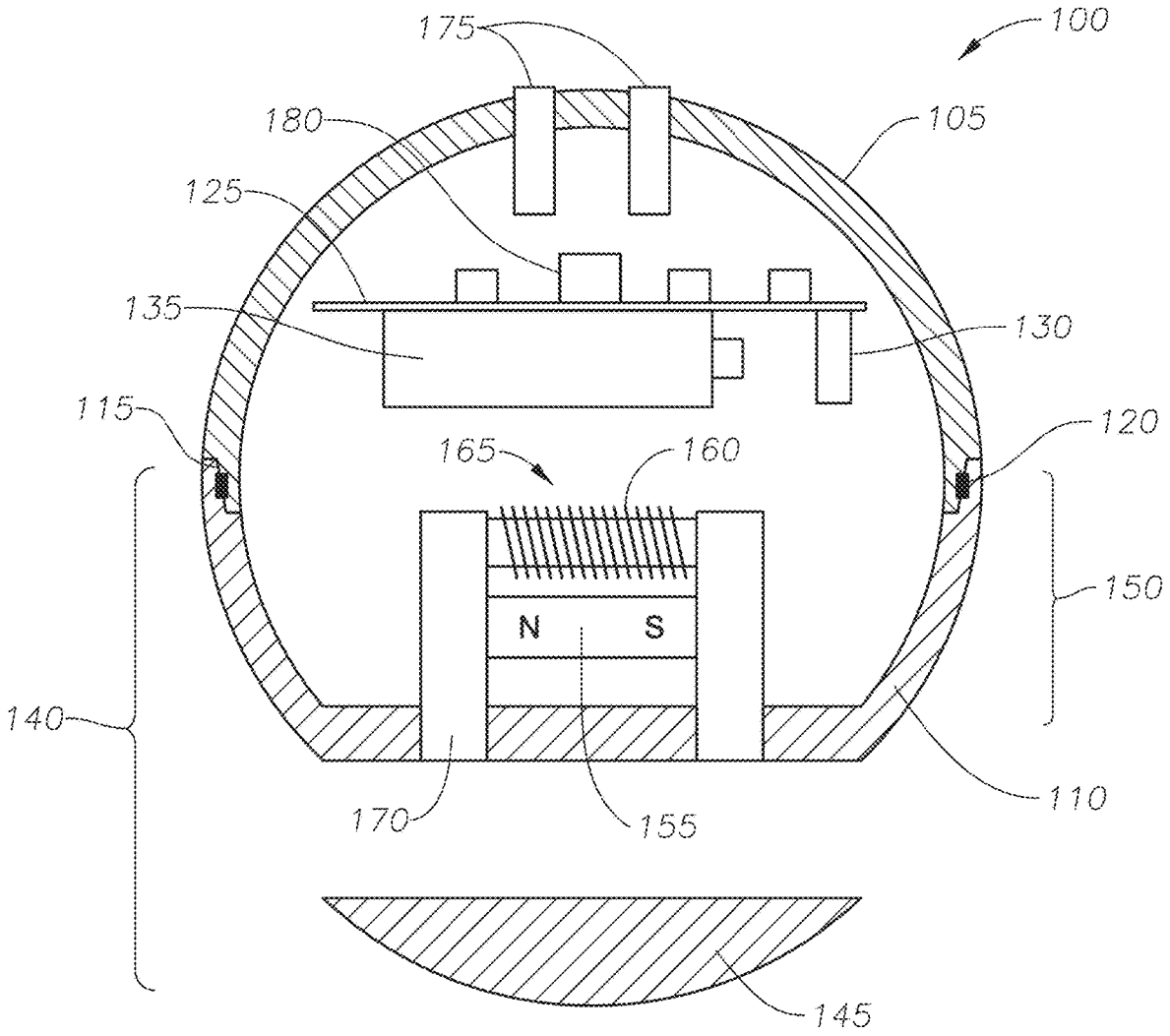
FIG. 1 shows an untethered measurement device according to an embodiment of the invention.

Advantages and features of the present invention and methods of accomplishing the same will be apparent by referring to embodiments described below in detail in connection with the accompanying drawings. However, the present invention is not limited to the embodiments disclosed below and may be implemented in various different forms. The embodiments are provided only for completing the disclosure of the present invention and for fully representing the scope of the present invention to those skilled in the art.

For simplicity and clarity of illustration, the drawing figures illustrate the general manner of construction, and descriptions and details of well-known features and techniques may be omitted to avoid unnecessarily obscuring the discussion of the described embodiments of the invention. Additionally, elements in the drawing figures are not necessarily drawn to scale. For example, the dimensions of some of the elements in the figures may be exaggerated relative to other elements to help improve understanding of embodiments of the present invention. Like reference numerals refer to like elements throughout the specification.

Hereinafter, various embodiments of the present invention will be described in detail with reference to the accompanying drawings.

According to at least one embodiment, there is provided an untethered apparatus for measuring properties along a subterranean well, whereby the untethered apparatus includes a housing, and one or more sensors configured to measure data along the subterranean well. The data includes one or more physical, chemical, geological, or structural properties along the subterranean well. The untethered apparatus further includes a processor configured to read the one or more sensors measuring the data and to store the measured data, and a transmitter configured to transmit the measured data to a receiver arranged external to the subterranean well. Further, the untethered apparatus includes a controller configured to control at least one of a buoyancy and a drag of the untethered apparatus to control a position of the untethered apparatus along the subterranean well.

According to at least one embodiment, the controller includes an actuator, which triggers a change in the at least one of the buoyancy and the drag, when activated by an electrical signal from the processor. In another embodiment, the controller includes a chemical or mechanical process, which causes the change in the at least one of the buoyancy and the drag independent of any electrical signal from the processor, for example, by a dissolution of a weight after a certain time, a state change (and associated density change) of a compound at a temperature, which corresponds to a certain position along the well, or a compression or a breaking of a mechanical linkage at a pressure, which corresponds to a certain position along the well. The processor includes instructions defining measurement parameters for the one or more sensors of the untethered apparatus within the subterranean well. In accordance with at least one embodiment, the untethered apparatus includes a weight, which is denser than the rest of the apparatus, and a weight securing means for securing and releasing the weight to and from the untethered apparatus to change the buoyancy of the apparatus to control a position or a direction of motion of the apparatus along the subterranean well.

In at least one embodiment, the controller includes at least one fin attached to the untethered apparatus and a controlling means for deploying and retracting the at least one fin, such that when the at least one fin is deployed, there is an increased drag on the apparatus from the flow along the well and when the at least one fin is retracted, there is a reduced drag on the apparatus from the flow along the well. In one embodiment, the apparatus is sufficiently heavy to descend in the well when the at least one fin is retracted despite an upward flow along the well of produced fluids, while the increased drag when the at least one fin is deployed is sufficient to cause the apparatus to ascend in the well.

In one embodiment, the apparatus changes both the drag, for example, by deploying at least one fin, and the buoyancy, for example, by dropping a weight, in order to change its trajectory from descending to ascending.

According to at least one other embodiment, there is provided a method for measuring properties at one or more specified locations along a subterranean well. According to at least one embodiment, the method includes programming movement of an untethered device along a subterranean well. A direction of motion of the untethered device along the subterranean well is controlled by changing a buoyancy or a drag of the untethered device when a certain condition occurs. According to at least one embodiment, the condition includes, for example, reaching a programmed distance along the well, reaching a certain vertical depth in the well, a passage of a certain amount of time, or a detection of a certain external condition. The method further includes releasing the programmed untethered device into the subterranean well, such that the untethered device descends in the subterranean well, and recovering the untethered device from the subterranean well after the untethered device changes the buoyancy and/or changes the drag and ascends in the subterranean well. Further, the method includes measuring and recording the data in the subterranean well during at least one of the descent of the untethered device and the ascent of the untethered device in the subterranean well, and downloading the recorded data to an external processor. This measured data includes, for example, one or more physical, chemical, geological, or structural properties along the subterranean well or dynamics of the untethered device itself within the well from which fluid or flow properties is inferred. Further, according to at least one embodiment, the method includes associating the data with a position along the subterranean well. In a preferred embodiment, a plurality of measurements are recorded and associated with their respective positions along the subterranean well.

According to at least one other embodiment, there is provided a method for measuring properties along a subterranean well, including the step of programming an untethered device for operation along a subterranean well, and specifying sensor measurements that are to be acquired, locations or times at which the sensor measurements are to be acquired, and conditions upon which the untethered device will change a buoyancy and/or change a drag. A position of the untethered device along the subterranean well is controlled by changing the buoyancy and/or the drag of the untethered device, upon occurrence of a specified condition, such as reaching a programmed distance, a passage of a certain amount of time, or a measurement of some physical, chemical, geological, or structural property outside the untethered device. The method further includes releasing the programmed untethered device into the subterranean well, such that the untethered device descends into the subterranean well, and recovering the untethered device from the subterranean well after the untethered device changes the buoyancy or the drag, and ascends in the subterranean well. Further, the method includes measuring and recording the data along the subterranean well during at least one of the descent of the untethered device and the ascent of the untethered device in the subterranean well, and downloading the recorded data to an external processor. This measured data includes, for example, one or more physical, chemical, geological, or structural properties along the subterranean well or dynamics of the untethered device itself within the well from which fluid or flow properties are inferred. Further, the method includes associating the data with a measurement location based on a trajectory of the well and a second measurement that constrains position on that trajectory.

According to at least one embodiment, there is provided an untethered apparatus for measuring properties along a subterranean well. The untethered apparatus includes a housing, and one or more sensors configured to measure data along the subterranean well. The data includes one or more physical, chemical, geological, or structural properties along the subterranean well. The untethered apparatus further includes one or more processors configured to control the one or more sensors measuring the data and to store the measured data. The processor includes instructions defining measurement parameters for the one or more sensors of the untethered apparatus within the subterranean well. The untethered apparatus further includes a transmitter configured to transmit the measured data to a receiver arranged external to the subterranean well, and a controller configured to control at least one of a buoyancy and a drag of the untethered apparatus to control a position of the untethered apparatus along the subterranean well. The untethered apparatus further includes a non-transitory computer-readable medium in communication with the one or more processors having computer-readable instructions stored therein that when executed cause the untethered apparatus to perform the steps of collecting data and changing a direction of movement of the untethered device along the subterranean well. A movement direction of the untethered device along the subterranean well is controlled by changing at least one of the buoyancy and the drag of the untethered device, upon occurrence of a certain condition, such as reaching a programmed distance, a passage of a certain amount of time, or a measurement of some physical, chemical, geological, or structural condition outside the untethered device. The method further includes releasing the programmed untethered device into the subterranean well, such that the untethered device descends into the subterranean well, and recovering the untethered device from the subterranean well after the untethered device changes at least one of the buoyancy and the drag and ascends in the subterranean well. Further, the method includes measuring and recording the data along the subterranean well during at least one of the descent of the untethered device and the ascent of the untethered device in the subterranean well, and downloading the recorded data on an external processor. The data includes one or more physical, chemical, or structural properties along the subterranean well, or a record of the motion of the device along the well from which properties of contents of the well is determined.

In one embodiment, the untethered device detects gaps between ends of casing joints or tubing joints by means of an inductive detector. The inductive detector includes two identical short solenoid coils of wire having the same radius, length, and number of turns and positioned on the untethered device such that they have a common axis. The coils would typically have the same radius as the untethered device and be positioned at its two ends (in the case of a cylindrical untethered device). Electrically, the coils are connected in a bridge configuration, for example, where they are in series and form one side of the bridge and the other side of the bridge is formed by two equal resistors in series. The bridge is driven by a frequency of typically 100 Hz to 1 MHZ (preferably 3 kHz) and a differential amplifier measures the degree of imbalance across the bridge. The driving frequency of the bridge is selected to be as high as possible, except that the skin depth for electromagnetic waves in the fluids within the well must be much larger (for example one thousand times larger) than the radius of the well so that the inductive coupling from each coil to the pipe is the same regardless of the position of the untethered device within the pipe.

According to at least one embodiment, if the coils are in a long uniform metal pipe, such as a tubing or casing section of equal diameter, their inductive coupling to the pipe will be equal and their inductance will be equal to each other, regardless of the position of the coils within the pipe or the inclination of their common axis relative to the pipe. In this case, no signal or a very small signal will be detected by the differential amplifier. If one coil is in a slightly larger diameter pipe than the other, as when one of them is close to the gap between pipe sections, then its inductance will be slightly larger than the other and the bridge will be out of balance, and a large amplitude signal will be detected by the differential amplifier. A microcontroller measures the amplitude of the signal from the differential amplifier (for example, using an analog to digital converter), and when the amplitude of this signal is larger, it knows that one coil or the other is near a gap between pipe sections. The microcontroller keeps track of how many such gaps it has passed and using records of the length of each pipe joint (which is recorded when constructing the well or may be mapped by running a casing collar locator logging tool in the well), it determines its own depth. When passing between gaps, the untethered device interpolates its position between pipe ends by dead reckoning based on accelerometer or inertial navigation unit measurements.

In one embodiment, the untethered device is used to obtain measurements along producing wells, which are producing fluids from downhole for at least part of the time while the apparatus is in the well or along pressurized wells, which contain a pressure at the well head, which is (or might be) in excess of ambient pressure outside the well head. In this embodiment, the untethered device is inserted and recovered through a "christmas tree" valve assembly found at the top of the well. the At the top of the christmas tree is generally a "swab valve", which is closed during production, but is opened to access the production tubing for cleaning or running wireline tools. Below the swab valve is a T-junction where a "production wing" extends horizontally off the christmas tree to carry produced fluids to the production facilities. A "production wing valve" is normally open during production, but blocks flow through the production wing when closed. Below the production wing, a "master valve" is normally open during production, but can be closed to block fluids from coming up the well. In accordance with one embodiment, to deploy and recover the untethered device in a well with such a christmas tree, two components are added. First, a screen or short pipe section with slits that pass the produced fluids, but do not pass the untethered device is inserted through the swab valve into the christmas tree, so that it allows flow out the production wing but will not allow the untethered device to pass out the production wing. Second, a sensor such as an acoustic detector is attached to the christmas tree near the production wing which detects the presence of the untethered device in the production wing, for example by detecting an acoustic transmission from the untethered device. To begin deployment of the untethered device, the master valve and production wing valves are closed. The untethered device is inserted through the swab valve which is closed behind it. Then the master valve is opened allowing the untethered device to fall into the well. If the measurements are to be made during production, the production wing valve is opened to allow production to resume. When the sensor returns to the surface, it will be trapped between the master valve and the swab valve and prevented from exiting the production arm by the screen. Once the sensor detects its presence near the production arm, the master valve and production arm valves are closed and the swab valve is opened at which point the untethered device is lifted from the christmas tree through the swab valve.

FIG. 1 shows an untethered measurement device according to an embodiment of the invention. As shown in FIG. 1, the untethered measurement device 100 (hereinafter referred to as the "device 100") includes a housing comprised of two hemispheres 105, 110 having edges that enable the two hemispheres 105, 110 to be secured to one another. According to at least one embodiment, the two hemispheres of the housing 105, 110 have threaded edges 115, such that the two hemispheres of the housing 101, 102 can be screwed to one another. One of ordinary skill in the relevant art would have understood that other securing means could be used for removably, securing the two hemispheres of the housing 105, 110 to one another.

As further shown in FIG. 1, the housing, according to at least one embodiment of the invention, further includes a seal 120, for example, an O-ring, arranged between the two hemispheres of the housing 105, 110 to provide a seal therebetween for protecting an internal cavity within the housing from external pressure or damage from an element (e.g., one or more downhole fluids) in the well, when the two hemispheres of the housing 105, 110 are secured to one another.

According to at least one embodiment, the two hemispheres of the housing 105, 110 are unscrewed and a cable is connected to one or more processors 125 through one or more connectors 130, each of which is contained in the internal cavity of the device 100 to program the device 100 and to download downhole property data measured by the device 100. While the two hemispheres of the housing 105, 110 are unscrewed, a battery 135, which is also contained in the internal cavity of the device 100, may also be replaced or recharged.

According to at least one embodiment, the battery 135 may be wirelessly recharged using inductive coupling or near field magnetic resonance coupling through an antenna (not shown) placed inside or outside of the device 100. The antenna may be, for example, a coil, planar spiral antenna, or a helical antenna, as non-limiting examples. The same antenna can be used to program the microcontrollers and transfer the stored data from the sensor to an interrogator wirelessly.

According to at least one embodiment, the internal cavity of the housing of the device 100 is substantially maintained at ambient pressure or less, even as the external pressure around the device 100 increases as the device 100 descends further down into the well or decreases as the device 100 ascends up through the well.

According to at least one embodiment, the two hemispheres of the housing 105, 110 and internal contents of the device 100 have a weight, such that an average density of the device 100 is less than an average density of the one or more downhole fluids in the well, which enables the device 100 to float in the one or more downhole fluids along the well.

According to at least one embodiment, the two hemispheres of the housing 105, 110 are made, for example, of a non-magnetic stainless steel material, but is not limited thereto.

According to at least one embodiment, the housing 105, 110 of the device 100 is spherical in shape to provide strength to the device 100 and to facilitate accurate prediction of a drag on the device 100 as it moves along the well. The drag under different flow conditions on spherical objects, such as is formed by joining the two hemispheres of the housing 105, 110, has been extensively measured and published in the open literature, less so for other shapes. In accordance with another embodiment, the housing 105, 110 is cylindrical in shape to provide strength to the device 100, for ease of manufacturing, and to increase the volume of the internal cavity of the device 100 for a given diameter. The diameter of the housing 105, 110 is less than the diameter of the casing, tubing, or hole in which it will operate.

According to at least one embodiment, the housing 105, 110 has a non-uniform distribution of density within it, such that the device 100 has a righting moment that maintains an orientation of the device 100 as it moves down and up in the well. According to at least one embodiment, the device 100 is configured to have a heavy end and a light end, such that the light end will be positioned up toward the top surface of the subterranean well and the heavy end positioned down toward the bottom of the subterranean well, as the device 100 moves in the well. In accordance with another embodiment, weight within the housing 105, 110 is distributed, so that the housing has no preferred orientation, allowing it unbiased movement in response to fluid motion along the well.

As further shown in FIG. 1, the device 100, according to at least one embodiment of the invention, includes a controller 140 for controlling a buoyancy of the device 100, and therefore controlling a movement of the device 100 along the subterranean well. According to at least one embodiment, in a well where one or more downhole fluids is stationary, descent of the device 100 is accomplished by the device 100 having an average density that is more than the average density of the one or more downhole fluids in the well (i.e., having negative buoyancy), and ascent of the device 100 is accomplished by the device 100 having an average density that is less than the average density of the one or more downhole fluids in the well (i.e., having positive buoyancy).

According to at least one embodiment, in a well where the one or more downhole fluids are upward moving fluids (e.g., during production when hydrocarbons are flowing from a subsurface hydrocarbon reservoir to the surface, or during drilling when drilling mud returns to the surface on the outside of a drill string), the device 100 has an average density that is greater than the average density of the one or more upward-flowing downhole fluids, in order for the device 100 to descend into the well against the flow of the one or more upward flowing downhole fluids. In this case, the change in direction of the device 100 from descending into the well to ascending up the well can be accomplished by changing the average density of the device 100 from being much more than that of the downhole fluids to be a little more than that of the downhole fluids, because of the additional drag force generated by the flow of the upward flowing downhole fluids.

According to at least one embodiment, in a well where the one or more downhole fluids are downward moving fluids (e.g., within the drill string during drilling), the device 100 needs to have an average density that is less than or slightly greater than the average density of the one or more downward flowing downhole fluids, in order for the device 100 to descend into the well with the flow of the one or more downward flowing downhole fluids. In this case, the change in direction of the device 100 from descending into the well to ascending up the well can be accomplished by changing the average density of the device 100 to be much less than that of the downhole fluids to ascend against the force generated by the flow of the downward flowing downhole fluids.

According to at least one embodiment, in a well with multiphase flows (i.e., a flow having at least two unmixed fluids, such as oil and water or oil, natural gas and water, or natural gas and water), the device 100 ascends up the well by making its average density less than or equal to at least one of the phases which is ascending the well in sufficiently large packages. For example, in a flow where alternating slugs of water and gas move up the well, the device 100 ascends up the well by having an average density that is less dense than the water phase, such that the device 100 ascends in a water slug.

According to at least one embodiment, the controller 140 includes a weight 145, for example, an iron weight; however, embodiments of the invention are not limited thereto. In one embodiment, the weight is made of a water dissolvable polymer, such as Bruce Diamond Corp (www.brucediamond.com/frac) uses to make water dissolvable frac balls with a density of 1.6 g/cc, such that the weight does not remain permanently within the well. The weight 145 is removably secured to an exterior surface, for example, a bottom exterior surface, of one of the two hemispheres of the housing 105, 110 of the device 100. In such an orientation, the weight of the weight 145 causes the device 100 to have a density greater than the one or more downhole fluids in the well, thereby causing the device 100 to descend into the one or more downhole fluids in the well. According to at least one embodiment, the controller 140 releases the weight 145 from the exterior surface of the one of the two hemispheres of the housing 105, 110 of the device 100, thereby causing the device 100 to ascend toward a top surface of the one or more downhole fluids in the well. Thus, the controller 140 is capable of controlling a buoyancy of the device 100.

As further shown in FIG. 1, the controller 140 of the device 100 further includes a weight securing means 150 for securing and releasing the weight 145 to and from the exterior surface of the one of the two hemispheres of the housing 105, 110 of the device 100. According to at least one embodiment, the weight securing means 150 includes, for example, one of a switching device or one or more magnets 155, 160, but is not limited thereto. The switching device 155, 160 includes, for example, a magnetic flux switching device, as a non-limiting example, and the one or more magnets includes one of a switchable permanent magnet or an electro-permanent magnet, as non-limiting examples.

According to at least one embodiment, the switchable permanent magnet includes an actuator and a permanent magnet. The actuator rotates the permanent magnet, so that a flux path of the permanent magnet either links or does not link the weight 145 to the exterior surface of the housing 105, 110 of the device 100.

According to at least one embodiment, the switching device 155, 160 is a flux switching device, which includes, for example, a coil of wire 165 that is energized to switch the flux of a permanent magnet between two stable paths, to control the connection between the weight 145 and the exterior surface of the housing 105, 110 of the device 100.

According to at least one embodiment, the electro-permanent magnet 155, as shown in FIG. 1, includes two permanent magnets connected in parallel, where one of the permanent magnets 155 is made of a material, for example, Samarium Cobalt (SmCo), which has a higher coercivity or resistance to having its magnetization direction reversed, while the second magnet 160 is made of a material, for example, Alnico V, which has a lower coercivity or resistance to having its magnetization direction reversed, and therefore can have its polarization direction changed easily. According to at least one embodiment, the size and material of the two permanent magnets 155, 160 is selected so that they have essentially the same magnetic strength (i.e., remnant magnetization). Furthermore, the coil of wire 165 is wrapped around the lower coercivity magnet (i.e. the second magnet 160 shown in the embodiment illustrated in FIG. 1) In another embodiment, the coil 165 may be wrapped around both magnets 155, 160 since the higher coercivity magnet is chosen such that it will not be repolarized by the field produced by the coil 165 and therefore it is unaffected by being included in that field. In another embodiment, there are an even number of magnets (2 or more) all of the same low coercivity material (such as Alnico V) and the same dimensions. The coil 165 is wrapped around half of those magnets, such that only half of the magnets have polarization adjusted by the coil 165. The advantage of making all magnets of the same low coercivity material is that it simplifies the problem of matching the magnetic strength of the repolarized and unrepolarized magnets to ensure exact field cancellation in the polarization state which cancels the fields. Failure to exactly cancel the fields in the polarization state designed to cancel the fields could result in failure to release the weight.

When a short (e.g., a two hundred (200) microsecond) pulse of a large electrical current (e.g., 20 amps) is applied to the coil of wire 165 in one direction, it permanently polarizes the lower coercivity magnet (i.e. the second magnet 160 shown in the embodiment illustrated in FIG. 1) in the same direction as the higher coercivity magnet (i.e. the first magnet 155 shown in the embodiment illustrated in FIG. 1), so that magnetic flux lines run through a flux channel 170 to the outside of the housing 105, 110, where they attract the weight 145 to the device 100. According to at least one embodiment, the flux channel 170 is made of a material, for example, iron, having a high magnetic permeability.

When an electrical current is applied to the coil of wire 165 in the opposite direction, it permanently polarizes the low coercivity magnet 160, in the opposite direction from the high coercivity magnet 155, so that the magnetic flux travels in a loop through the two magnets 155, 160 and end pieces, but does not substantially extend outside those pieces, removing the force that held the weight 145 to the device 100 and allowing the weight 145 to drop free from the device 100. As a result, the device 100 ascends within the well.

One of ordinary skill in the relevant art will recognize that there are other means of holding and releasing the weight. All such means are within the scope of this invention. For example, in other embodiments, the controller 140 of the device 100 applies an electrical current to generate heat that melts through a coupling between the weight 145 and the housing, applies an electrical current to energize a mechanical device, such as a solenoid to release the weight 145, or shuts off an electrical current to de-energize a mechanical device, such as a solenoid or an electromagnet that retains the weight 145, each causing the weight 145 to drop from the device 100.

One of ordinary skill in the relevant art will further recognize that dropping a weight is only one method for changing the buoyancy of the device and there are other methods by which the buoyancy of the device could be changed. These other methods of changing buoyancy are also within the scope of this invention. For example, other methods of changing buoyancy include, expelling liquid out of a compartment or a ballast tank, for example, by triggering a chemical reaction or using an electrochemical process to generate gas within the ballast tank to displace the liquid, or by pushing the liquid out using a mechanical plunger, or pumping it out using a pump. In another embodiment, buoyancy is changed by means of a piece of material which is attached to the device and which is caused to go through a phase change (e.g., melting or freezing), such that the mass of the material remains the same, yet its volume changes. The material is situated in the device, so that a change it its volume causes a change in the total volume of the device, for example, in one embodiment the material is contained in a compliant container which is in contact with downhole fluids in the well (i.e., not contained within an entirely rigid housing), such that when the phase change occurs and the material expands or contracts, the container also expands or contracts, and the overall volume of the device increases or decreases. Embodiments of the invention provide that there is a natural geothermal temperature gradient in wells, such that the temperature increases with depth. Thus, making part of the device, in accordance with an embodiment of the invention, from a material, which expands when melting and contracts when freezing makes the device become lighter near the bottom of the well (eventually causing it to ascend) and heavier at the top of the well (eventually causing it to descend). The phase change temperature of the material and the thermal conductivity between the outside environment and the material is selected to cause the device to travel back and forth between specified depths. In one embodiment, an electronic controller in the device applies additional heating or cooling to the material, for example through a Peltier junction, to further control when the phase change takes place and therefore when the buoyancy change takes place. In one embodiment, the phase changing material is paraffin wax (which typically has a melting point between 46 and 68 degrees Celsius and undergoes a volume increase of about 15% when melting [Ukrainczyk, "Thermophysical Comparison of Five Commercial Parafin Waxes as Latent Heat Storage Materials, Chem. Biochem. Eng. Q., 24(2) 129-137 (2010)].

According to at least one embodiment, the housing diameter and the device density before and after its buoyancy change are optimized to achieve the desired descent and ascent rates given the density, viscosity, velocity and flow regime of the one or more downhole fluids in the well and for the diameter of pipe, casing, or hole in which the device 100 will operate. One of ordinary skill in the relevant art will recognize that increasing the weight of a device 100 will tend to make it descend more quickly or rise less quickly. Similarly, increasing the diameter of the device 100 will tend to couple the device 100 more closely to the surrounding flow, such that the device 100 tends to move with the surrounding flow, rather than moving contrary to that flow in the well. This is especially true once the diameter of the device 100 is a substantial fraction, about 25% or more, of the pipe diameter.

Thus, the controlled movement of the device 100, according to various embodiments of the invention, is bi-directional, in that the device 100 travels down the well after the device 100 is deployed, and travels up the well, after the controller changes buoyancy or drag, such that the downhole fluids return the device 100 back to the top surface of the subterranean well. It will be understood that moving up or down the subterranean well refers to moving along the trajectory of the well toward the shallower or deeper (respectively) ends of that trajectory.

As further shown in FIG. 1, the device 100, according to at least one embodiment, includes one or more sensors for measuring downhole properties along the well, as the device 100 descends and ascends in the well. For example, the one or more sensors are configured to measure one or more physical, chemical, and structural properties of the well. The physical, chemical, and structural properties of the well include, but are not limited to, temperature, pressure, "water cut", which is an amount of water or brine present in downhole fluids, volume fractions of brine and of hydrocarbons in the downhole fluids, flow rate of oil, water, and gas phases, inflow rate of the oil, water, and gas into the well from surrounding rock formations, the chemical composition of the brine mixture, the chemical composition of hydrocarbons, the physical properties of the hydrocarbons, including, for example, density or viscosity, the multiphase flow regime, the amount of corrosion or scale on the casing or production tubing, the rates of corrosion or scale buildup, the presence or absence of corrosion inhibitor or scale inhibitor that might be added to the well, the open cross-section within the production tubing or borehole which would conventionally be measured by calipers, the acoustical or elastic properties of the surrounding rock, which may be isotropic or anisotropic, the electrical properties of the surrounding rock, including, for example, the surrounding rock's resistive or dielectric properties, which may be isotropic or anisotropic, the density of the surrounding rock, the presence or absence of fractures in the surrounding rock and the abundance, orientation, and aperture of these fractures, the total porosity or types of porosity in the surrounding rock and the abundance of each pore type, the mineral composition of the surrounding rock, the size of grains or distribution of grain sizes and shapes in the surrounding rock, the size of pores or distribution of pore sizes and shapes in the surrounding rock, the absolute permeability of the surrounding rock, the relative permeability of the surrounding rock, the wetting properties of fluids in the surrounding rock, and the surface tension of fluid interfaces in the surrounding rock.

According to at least one embodiment, the one or more sensors includes a position sensor 175 configured to measure the location of the device along the well. In one embodiment, the position sensor is a pressure sensor, which measures the pressure acting on the device 100 for determining the depth at which the device 100 is positioned along the well or within the one or more downhole fluids in the well, where a relationship between pressure and depth is determined from one of theoretical calculations, laboratory experiments, and field tests.

In accordance with another embodiment, the one or more sensors includes a position sensor 175 configured to calculate an amount of time that the device 100 has been descending down into the well, where a relationship between time and depth is determined from one of theoretical calculations, laboratory experiments, and field tests.

In accordance with another embodiment, the position sensor 175 is a casing or tubing collar detector configured to detect when the device 100 passes a casing or tubing collar in the well and continues to count the number of casing or tubing collars, which have been passed in the well to determine the depth of the device 100 in the well. In particular, the presence of a casing or tubing collar is detected based on an additional pipe thickness at the casing or tubing collar or is detected based on the gap between pipe joints at the casing or tubing collar or is detected based on the larger diameter of the pipe joints at the casing or tubing collar, determined, for example, by inductive, electromagnetic, or acoustic means, and where the depth of the device 100 is calculated based on the number of casing or tubing collars passed and optionally interpolated between casing or tubing collars based on at least one selected from the group consisting of time, pressure, and accelerometer data, since the last casing or tubing collar was passed. In accordance with at least one embodiment, the casing collar or tubing collar detector transducer is the one or more transducers described below for converting a physical property of interest into a measurable electrical signal.

In accordance with another embodiment, absolute reference points from casing or tubing joint ends or collar detections are combined with inertial navigation data or accelerometer data to interpolate the position of the device 100 within pipe joints or between collars. The collars connect individual pipe or casing joints (i.e., pipe sections) together. Their locations are well known from the well design or can be accurately surveyed by a collar detecting wireline tool. Position along the well can also be determined from measured hydrostatic pressure. This method of determining location is less accurate than the combination of collar detection with inertial navigation, especially if the density profile (i.e., density vs. depth) of the one or more downhole fluids in the well is uncertain, however it is simpler to implement and can operate where there are no collars present, such as in an open (uncased) hole. According to at least one embodiment, position along the well is also determined by the elapsed time the device 100 has been moving based on the predicted velocity of the device 100. This is the least accurate method of determining position along the well due to uncertainty in the device 100 velocity. Position estimation, or the determination of position in the well, is aided by mapping the depth of detectable landmarks and providing the device 100 with a detector configured to detect these landmarks. For example, beacons or RFID tags are placed at known locations in the well to aid in position determination. In another example, features of convenience are used, such as changes in tubing diameters or properties of the surrounding rock formations. In accordance with an embodiment, the device 100 integrates multiple sources of position information to provide maximal accuracy in position estimation and to minimize the risk of mission failure.

According to at least one embodiment, velocity of the device 100 is determined using acoustic Doppler backscatter from the wall of the well or pipe containing the device 100. Device 100 velocity relative to the downhole fluids is determined by comparing the relative velocity between the device and the downhole fluids in front vs. behind the device 100, as determined by acoustic Doppler backscatter measurements in both directions. Device 100 velocity relative to the well downhole fluids is also determined by ultrasonic echolocation, measuring difference in acoustic time of flight between two ultrasonic transducers when the first transducer is a transmitter and the second transducer is a receiver versus when the first transducer is the receiver and the second transducer is the transmitter. Device 100 velocity relative to the well downhole fluids is also calculated from the difference in acoustic travel time directly between two transducers versus along a second propagation path between the transducers, which also reflects from the inner surface of the borehole or pipe that contains the device 100. This calculation requires knowing the distance from each transducer to the inner surface, which is determined by measuring the acoustic round trip travel time from each sensor to the inner surface and back.

According to at least one embodiment, device 100 position in the horizontal direction (or perpendicular to the axis of the well) is determined by measuring the two-way travel time of an acoustic signal emitted by an array on the surface of the housing 105, 110 of the device 100 and reflected back to the device 100 by the inner surface of the pipe, tubing, casing, or borehole that contains the device 100. Alternatively, inductive coils near the outside surface of the device 100 measure distance to the inside wall of a metal pipe based on the losses they sense from eddy currents induced in the pipe. Accelerations of the device 100 and position changes over short time period are calculated from accelerometers or an inertial navigation system mounted in the device 100. However such measurements are subject to drift, so that other methods must be relied upon for position information that is stable over the long term According to at least one embodiment, the device 100 changes buoyancy or drag, initiating the return to the surface, when a certain condition on a certain measured quantity is attained. The measured quantity may be, for example, but is not limited to, (1) time, where the buoyancy or drag change is triggered when the current time or elapsed time equals or exceeds a specified time, (2) pressure, where the buoyancy or drag change is triggered when the pressure equals or exceeds a specified pressure, (3) depth, where the buoyancy or drag change is triggered when the depth equals or exceeds a specified depth, (4) temperature, where the buoyancy or drag change is triggered when the temperature equals or exceeds a specified temperature, (5) fluid characteristics, where the buoyancy or drag change is triggered when fluid characteristics outside the sensor are measured to be within ranges corresponding to a fluid of interest, such as measuring the dielectric properties or conductivity of the fluid outside the device 100 and changing buoyancy or drag when those properties are within such a range as to indicate that the fluid outside the device 100 is, for example, gas condensate vapor, oil, brine, dry gas, a liquid, a vapor, or a gas.

According to at least one embodiment, the one or more sensors 175 includes a downhole property sensor configured to measure one or more downhole properties of the one or more downhole fluids in the well. The one or more downhole properties include, but are not limited to, density or viscosity of the one or more downhole fluids in the well. In one embodiment, the sensor is comprised of a mechanical oscillator such as, but no limited to, a piezoelectric tuning fork, along with the necessary circuitry to actuate and sense its motion. This mechanical oscillator would directly probe the fluid through the interaction of its prongs, or mechanically active part, with the boundary layer of fluid around it. Through in-situ or laboratory calibration, the response of the motion, in time or frequency domain, of the device can be directly correlated to physical properties of the fluid such as, but not limited to, the viscosity, density, compressibility, and dielectric constant.

According to at least one embodiment, the one or more sensors 175 includes an accelerometer configured to measure device accelerations. This acceleration data is then related to one of: a flow regime or a presence of inflow of one or more constituents (e.g., oil, water, gas, etc.) into the well based. Flow regimes or inflow into the well will have a characteristic effect on the pattern of accelerations experienced by the device 100, and these patterns may be detected to determine flow regime and quantify inflow.

According to at least one embodiment, the one or more sensors 175 includes a chemical sensor configured to measure a chemical property of the one or more downhole fluids in the well.

According to at least one embodiment, the one or more sensors 175 each includes one or more transducers (not shown) that convert, for example, a physical property of interest into a measurable electrical signal. The physical property of interest includes, for example, but is not limited to, the density, viscosity, velocity, turbulence, flow regime, temperature, or chemical composition of the one or more downhole fluids in the well. The physical property of interest also includes, for example, but is not limited to, the degree of corrosion, scale buildup, distortion from round, hole diameter, pipe diameter, mudcake thickness, mudcake coverage, pipe coupling locations, or locations of the ends of pipe joints in the well or inside tubing or casing pipes within the well. The physical property of interest also includes, for example, but is not limited to, the depth, location, or lateral location, velocities, or accelerations of the device 100 within the well. The physical properties of interest may include the condition, setting state, or integrity of cement within the well. The physical property of interest also includes, for example, but is not limited to, electrical, acoustical, mechanical, compositional, fluid content, density, or flow properties of the rock formations near the well. The physical property of interest may also include, for example, but is not limited to, the pressure at the device 100 or distance between devices 100. The physical property of interest may also include, for example, but is not limited to, the strength of an electromagnetic signal transmitted from a nearby device 100 or nearby fixed transmitter, such as a microwave or inductive signal, which is transmitted to ascertain properties of the surrounding fluid, well, or rock formations.

According to at least one embodiment, the physical property of interest includes, for example, but is not limited to, the diameter of the well, the cross-sectional area of the well, the roughness or distance from the device 100 to a rock face, pipe surface, tubing surface, or casing surface within a well.

These physical properties could be determined by measuring acoustic travel time or the character of the acoustic signal emitted by an array on the surface of a ball and reflected back to a sensor by the inner surface of the pipe, tubing, casing, or borehole that contains the sensor. Measurements of these physical properties would be valuable, for example, in determining an amount of scale buildup in a well to decide whether to apply an anti-scaling treatment, whether to clean the well, or whether to replace a pipe, tubing, or other mechanical component within the well. In another example, these measurements are useful in determining an amount of corrosion in a well to decide whether to apply corrosion inhibitors or whether to replace pipe or tubing within the well. Such measurements are also useful to predict when pipe or tubing or other mechanical components within the well need to be replaced due to scale or corrosion. In another example these measurements are useful in measuring the size of the borehole to determine an amount of cement required to cement in the casing and assessing whether there are large vugs, pore spaces, karstic features, or washout zones, which will cause cement or drilling mud to be lost into the rock formations, assessing the stability of subterranean rock layers to decide whether a particular rock layer will require casing. Generally, in measuring dimensions within a well (i.e., the dimensions of the borehole or of pipe, tubing, or casing within the well), the one or more sensors of the device 100, according to at least one embodiment, serves the same set of applications as a calipers log (or well dimensions log), but without the added cost of mobilizing a wireline crew and surface support vehicles and without the need to kill the well or use a blowout preventer (BOP) and lubricator system to operate in a producing well. In addition the one or more sensors of the device 100 pass through smaller constrictions within the well, such as valves, bypasses, pipe bends, and annuluses between pipes or between pipes and rock formations, where a wireline calipers tool may be unable to go.

In accordance with at least one embodiment, the physical property values include the acoustic or elastic properties of the interface between casing and cement or between cement and the rock formations around the well. These properties would typically be determined, using conventional tethered measurement devices, by emitting acoustic signals from the ball that would reflect from or travel along the interfaces between casing, cement, and or rock formations. According to various embodiments of the invention, the device 100 records the travel times, propagation paths, amplitudes, and phases of these signals for indicating the strength of the bond between the cement and the casing or rock formations, which is a critical property for ensuring pressure isolation between rock formations, well control, and the general safety of the well.

In accordance with at least one embodiment, the measured physical property values include, but are not limited to, the upward flow velocity within the well, the upward flow velocity or volume fractions of one or more of the fluids within the well, the inflow into the well from the rock face or from perforations or holes in a pipe or tubing or casing within the well, the density and/or viscosity of one or more fluids within the well or of a combination of fluids within the well. Flow velocity (both upward and into the well), the volume fractions of different fluids, and the physical properties (such as density and viscosity) of the fluids can be determined by measuring the time history of the location of the device 100 as it falls and rises within the well, or equivalently, measuring the path and velocity of the device 100 through the well.

In accordance with at least one embodiment, the velocity of the device 100 along the well is related to the density difference between the device 100 and the one or more downhole fluids, the viscosity of the one or more downhole fluids, and the vertical flow velocity in the well, according to theoretical calculations and laboratory studies familiar to persons skilled in the relevant art. According to at least one embodiment, this relationship can be utilized to determine the viscosity, flow velocity, and density of the one or more downhole fluids in the well from the velocity of the device 100 moving through the well, especially when the velocity is measured with the one or more sensors 175 of the device 100 at two different densities (i.e., before and after the change of buoyancy). To better constrain the calculation of density, viscosity, and flow velocity, a plurality of devices 100 of different densities is deployed into the well. When the density of a device 100 is matched to that of a particular fluid phase in a multiphase flow, the device 100 will tend to remain with that fluid phase, providing information about the dynamics of that particular phase within the flow. Once measured, the device 100 velocity may be used in inferring the density difference between the device 100 and the surrounding downhole fluid, the viscosity of the downhole fluid, the velocity of the downhole fluid phase that best matches the density of the device 100 and/or the velocity, density, and viscosity of the emulsion of the one or more downhole fluids that contains the device 100. Applications for measuring the flow velocity, viscosity, and density include, for example, but are not limited to, optimizing bottom hole pressures and artificial lift systems in the well to maximize the recovery of oil or gas to the surface or to optimize the ability to prevent unwanted water or brine from entering wells. Knowing flow density is also a good indication of water cut or water holdup, which is the percent of water among the produced downhole fluids in the well. Mapping water cut vs. distance along the well can reveal where water is entering the well, guiding efforts to stop and reverse water breakthrough.

Measurement of the flow velocity variation with depth makes it possible to calculate the amount of inflow into the well as a function of depth. As the device 100 passes a port where inflow is occurring, its path will be deviated away from the port. Thus, tracking the horizontal position of the device 100 within the well as a function of depth also provides a measure of inflow. Applications for measuring inflow into wells include deciding on the depth at which to place horizontal wells or the depths at which to complete vertical wells for optimal recovery of hydrocarbons, verifying that perforations or hydraulic fracturing jobs have been successful and deciding whether to rework, measuring response of the earth to certain hydraulic fracturing designs to determine the optimal parameters for future fracturing, and improving reservoir models by providing real inflow data to compare with model predictions.

According to at least one embodiment, the accelerations of the device 100 (as measured by accelerometers or inertial navigation systems), also indicate the flow regime and amount of turbulence in the flow. Knowing the flow regime and amount of turbulence in the well as a function of position along the well aid in adjusting artificial lift parameters and pressure draw down to optimize production and maximize the life of downhole systems.

As further shown in FIG. 1, the device 100, according to at least one embodiment, further includes the one or more processors 125, which controls the operation of the device 100, the battery 135, which powers the device 100 and the electrical components contained therein, and the one or more connectors 130 used to program the device 100 and to download downhole property data measured by the device 100, when the two hemispheres of the housing 105, 110 are unsecured from one another and the housing is opened up.

According to at least one embodiment, the one or more processors 125 includes a non-transitory computer readable memory medium (not shown) having one or more computer programs stored therein operable by the one or more processors 125 to control the operation of the device 100 and to store the downhole property measured by the one or more sensors 175 of the device 100. The one or more computer programs can include a set of instructions that, when executed by the one or more processors 125, cause the one or more processors 125 to perform a series of operations for controlling the descent of the device 100 down into the well, measuring the downhole properties of the well as the device 100 descends down into the well, controlling the release of the weight 145 from the exterior surface of the one of the two hemispheres of the housing 105, 110 of the device 100, and measuring the downhole properties of the well as the device 100 ascends up the well to the top surface of the subterranean well. The measurements stored in the non-transitory computer readable memory medium is extracted when the device 100 returns to the top surface of the subterranean well, and the device 100 is opened up, such that an external computer can be connected to the one or more connectors 130.

According to at least one embodiment, a measurement plan is programmed into the processor 125, where the measurement plan includes the types and locations of measurements, which the one or more sensors 175 will make. In one embodiment, this measurement plan is programmed into the processor 125, before the device 100 is deployed. According to at least one embodiment, the device 100, once deployed, does not change the measurement plan based on the data values collected or based on any communication after deployment, while according to another embodiment, the measurement plan of the device 100 changes, in real-time, in response to the data values collected or based on a communication after deployment.

According to at least one embodiment, the one or more connectors 130 is a wired connection, for example, a serial or USB connector, as non-limiting examples. According to at least one other embodiment, the one or more processors 125 further includes a transmitter 180 to wirelessly connect the one or more processors 125 to an external computer or device for receiving operational instructions for the device 100 and for downloading downhole property data measured by the device 100. In one embodiment, the wireless transmitter 180 is configured as one of a Bluetooth or Xbee radio module that enables a radio-frequency wireless transfer of data and operational parameters. In one embodiment, the wireless transmitter 180 includes an LED and a photodetector or phototransistor that enables optical communication, or a coil of wire that enables inductive communication. According to various embodiments of the invention, wireless communication between the device 100 and an external computer is preferred over a wired communication connection.

According to at least one embodiment, one of ordinary skill in the relevant art will recognize that various types of memory, for example, in the form of an integrated circuit having a data storage capacity, are readable by a computer, such as the memory described herein in reference to the one or more processors of the various embodiments of the present invention. Examples of computer-readable media can include, but are not limited to: nonvolatile, hard-coded type media, such as read only memories (ROMs), or erasable, electrically programmable read only memories such as EEPROMs or flash memory; recordable type media, such as flash drives, memory sticks, and other newer types of memories; and transmission type media such as digital and analog communication links. For example, such media can include operating instructions, as well as instructions related to the apparatus and the method steps described above and can operate on a computer. It will be understood by one of ordinary skill in the relevant art that such media can be at other locations instead of, or in addition to, the locations described to store computer program products, e.g., including software thereon. It will be understood by one of ordinary skill in the relevant art that various software modules or electronic components described above can be implemented and maintained by electronic hardware, software, or a combination of the two, and that such embodiments are contemplated by embodiments of the present invention.

Figure 2:
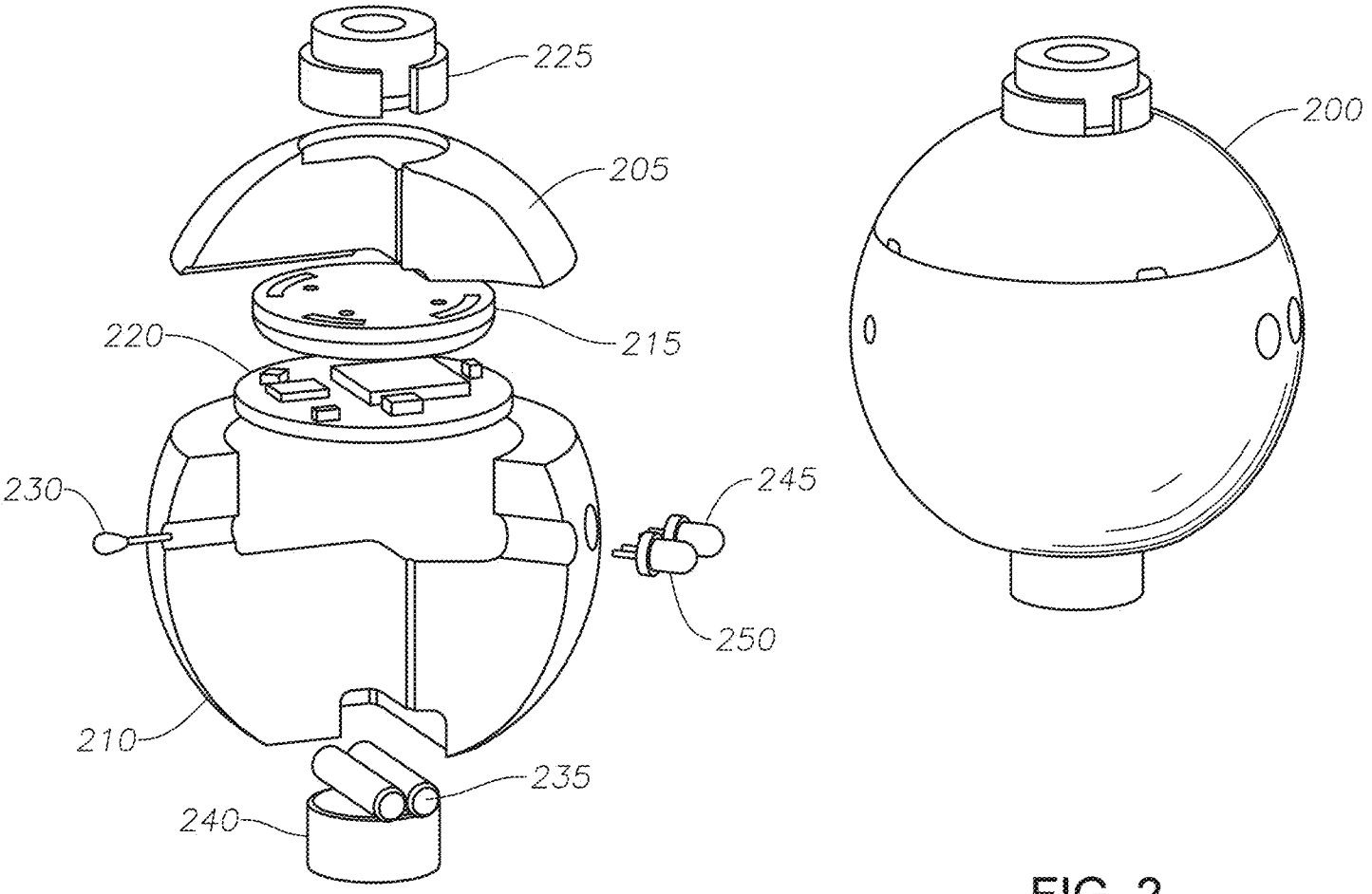
FIG. 2 shows an untethered measurement device according to an embodiment of the invention.

FIG. 2 shows an untethered measurement device according to an embodiment of the invention. In FIG. 2, the device 200 is shown twice: assembled (on the right) and in an expanded and cut-away view (on the left) to make the components of the device 200 more visible. The two pieces of the housing of the device 205, 210 are made, for example, of syntactic foam, which provides sufficient buoyancy for the device to ascend in the well, as a non-limiting example. In one embodiment, the interior and exterior of the housing 205, 210 are all at substantially ambient pressure. The battery 215 and control and data logging electronics 220 are also at ambient pressure and are surrounded by a liquid or compliant potting material. According to one embodiment, the internal cavity of the housing 205, 210 of the device 200 is filled with a non-conductive liquid, for example, mineral oil or castor oil, as non-limiting examples, or with a non-conductive compliant solid, for example, silicone grease or silicone rubber, and additionally, at least a portion of the housing 205, 210 is made compliant to provide pressure compensation to the internal cavity of the device 200.

According to at least one embodiment, sensors 225, 230 and measure properties of the fluids in the well. An optical communication link (not shown) allows for programming the device 200 with instructions regarding the depths or times at which to obtain sensor measurements and the depth or time at which to change buoyancy and return to the surface. Buoyancy may be changed in a variety of ways. In one embodiment, a magnet 235 is reversed in polarity by an electrical signal from the control electronics 220 cancelling the field of an adjacent companion magnet, and causing a weight 240 to be released from the device 200. Once the device 200 returns to the surface, the data is downloaded from the device 200. In one embodiment, the data is downloaded over an optical communication link, with data being transmitted by a light emitting diode 245 in the device 200 and data being received by a phototransistor 250 in the device 200.

Figure 3:
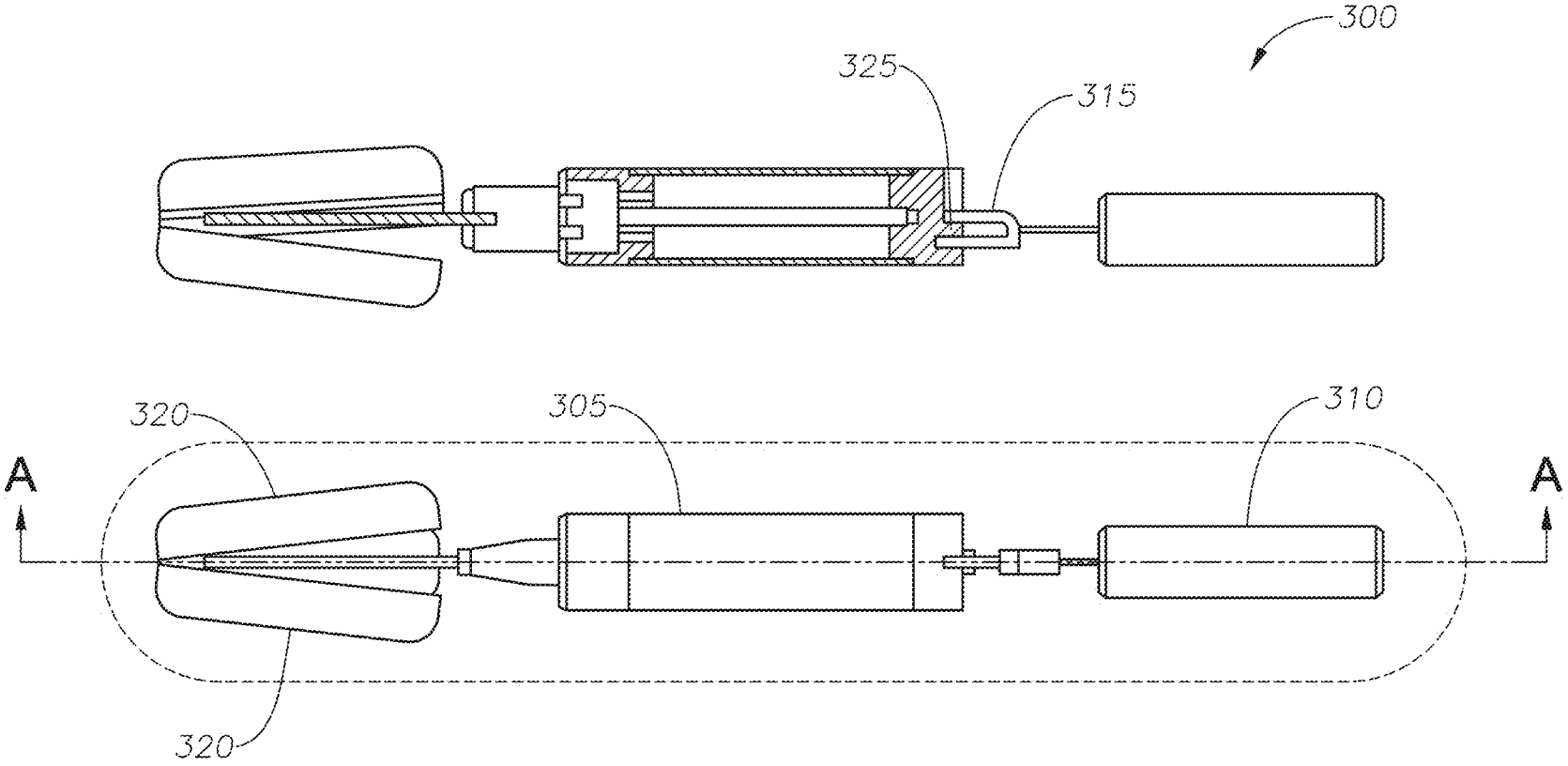
FIG. 3 shows an untethered measurement device according to an embodiment of the invention.

FIG. 3 shows an untethered measurement device according to an embodiment of the invention. The lower image shows a side view of the device, and the top image shows a cut-away view of the device along its axis. The device 300 consists of a control module 305, which contains batteries along with control and data logging electronics, a weight 310, which is attached to the control module 305 by a pelican hook 315, and a flotation assembly with deployable fins 320. An electronically actuated release 325 either releases or holds on to the pelican hook 315. When the electronically actuated release 325 lets go of the pelican hook 315, the weight 310 is released from the control module 305, changing the overall buoyancy of the device. The fins 320 of the flotation assembly are electronically or mechanically actuated by the control module 305 to adjust the drag of the device. As shown the fins 320 are in the deployed position where they extend beyond the diameter of the control module 305, presenting an increased profile to flow in the well and increasing the drag of the device. When the fins 320 are retracted, they do not extend beyond the diameter of the control module 305, so they create little additional drag. By deploying or retracting the fins 320, the control module 305 is able to adjust the drag of the device.

According to at least one embodiment, the device also includes a volume filled with a corrosion inhibitor or scale inhibitor chemical, a dispenser configured to dispense a measured amount of the chemical, and a controller that causes the chemical to be dispensed under specified conditions, such as at a particular location in the well, time, depth, or in response to obtaining a particular sensor reading indicating the need to dispense the chemical. Embodiments of the invention provide that the scale inhibitor can control scale in a few ppm and chemicals, such as 2-mercaptoethylsulfide can control $CO_2$ corrosion at 500 ppb, thus the small required volumes could be carried and dispensed by an untethered device. (for example, a gas well producing 35 MMscfd, 53 bbl/d water just needs 4 ml/day of pure chemical).

According to at least one embodiment, the device operates in a riser or in an inclined or vertical section of a pipeline instead of or in addition to operating in a subterranean well. In one embodiment, the device makes measurements of pipeline properties, such as corrosion, scale, presence of standing water, and/or presence of biological organisms that contribute to corrosion.

According to at least one embodiment, the device operates in the vertical section of well before the laterals (or horizontal sections) of the well are drilled and data collected by the device is used to decide whether to drill the planned laterals or to adjust the drilling parameters such as the trajectory, depth, length, or mapview location of the planned laterals. In one embodiment, the device further makes measurements of downhole properties such as, for example, the susceptibility of the surrounding rock formations to hydraulic fracturing or the presence of fractures in the surrounding rock formations or the presence hydrocarbons in the surrounding rock formations. In one embodiment, the decision of whether to drill the laterals and complete the well is made based, at least in part, on measurements of downhole properties in the reservoir interval made by the untethered device in the vertical section of the well.

According to at least one embodiment, the device has reservoirs to carry one or more type of tracers in the form of permanent or rewritable RFID tags or physically or chemically distinguishable particles of various size and composition. The untethered device, according to various embodiments of the invention, can be programmed to release specific tracers at predefined events such as at specific temperature, pressure, or a chemical encounter, or when untethered device is immobilized or its batteries are about to die. These tracers can be moved up to the surface with the fluid flow and detected at the surface using specialized tools such as wireless interrogators, optical, acoustical, or magnetic detection and/or imaging tools.

According to at least one embodiment, the device has reservoirs to carry rewritable RFID tags and an antenna; so that, RFID tags can be rewritten wirelessly using near or far field radio waves or inductive coupling. The antenna can be a coil or a spiral, helical, dipole, or patch antenna depending on the wireless communication platform. The untethered device can be programmed to release a specific quantity or all of the tags at predefined events and detected as described in the previous paragraph. In this scheme, sensor ball can be programmed to stay in a specific location of the well for extended time periods to perform semi-continuous measurements, and the data packages can be sent up to the surface at shorter time intervals.

According to at least one embodiment, the device is used to recharge the batteries of permanent sensors placed downhole and fetch information from them. The power transfer and communication between the permanent sensors and the sensor ball can be realized via several means such as temporary hard contact of electrodes, or wirelessly using near or far field radio frequency electromagnetic waves/fields, inductive coupling, or acoustic or pressure waves.

According to at least one embodiment, the device performs optical, electromagnetic, or acoustical imaging employing a light, electromagnetic, or acoustic source at the desired wavelength band, and an optical, electromagnetic, or acoustical detector array capable of measuring the intensity of the incident light, electromagnetic or acoustical signal. In one embodiment the light source or electromagnetic source, or acoustical source and/or the receiver or receiver array is rotated to acquire a wide-field image. In an embodiment, the received signal intensity is measured at a plurality of wavelengths to provide spectral information useful for distinguishing fluid and rock types, properties, and composition.

According to at least one embodiment, the untethered device has fluidic inlets to take fluid samples where filters with a fine mesh filter from the fluid residual mud and rock pieces. In one embodiment, valves direct the fluid to various sensors (e.g. viscosity, density, permittivity, acoustic wave propagation, fluorescence, optical absorption) for in-situ analysis. In one embodiment, the fluid is sealed in a reservoir for further laboratory analysis.

According to at least one embodiment, the device further includes a light source and an optical camera for optical imaging. The device further includes an acoustic source and an acoustic sensor array for acoustic imaging. The device further includes one or more fluidic inlets with filters to take fluid samples, whereby the one or more fluidic inlets direct collected fluid to the one or more sensors for in-situ analysis or to a reservoir and seals the fluid for laboratory analysis. According to at least one embodiment, the device further includes one or more microfluidic channels to perform phase separation and to control temperature and pressure of the collected fluid. The device further includes a based lab-on-a-chip, where electrical, optical, and mechanical properties of the collected fluid are measured.

According to at least one embodiment, the device further includes a reservoir to keep one or more type of tracers in the form of permanent or rewritable RFID tags or physically or chemically distinguishable particles of various size and composition. Specific tracers, such as the RFID tags, can be released based on predefined events. The tracers are moved up to the surface with the fluid flow. The tracers are detected at the surface using specialized tools. All or part of the collected data is written on rewritable RFID tags. Data stored in the RFID tags can be retrieved using telemetry.

According to at least one embodiment, there is provided an untethered device for measuring properties along a subterranean well. The untethered device includes a housing, a telemetry system that can communicate with one or more permanent downhole sensors, and one or more processors configured to control the communication with permanent sensors and to store the retrieved data. The untethered device further includes a transmitter configured to transmit the retrieved data to a receiver arranged external to the subterranean well, and a controller configured to control a buoyancy of the untethered device for controlling a position of the untethered device in the subterranean well, whereby the controller includes a weight attached to an exterior surface of the untethered apparatus, and a weight securing means for securing and releasing the weight to and from the exterior surface of the untethered apparatus for controlling the position of the untethered device in the subterranean well. Further, the untethered device includes non-transitory computer-readable medium in communication with the one or more processors having computer-readable instructions stored therein that when executed cause the untethered device to perform various steps. For example, the steps may include programming movement of the untethered device in the subterranean well, whereby a position of the untethered device in the subterranean well is controlled by changing the buoyancy of the untethered device, upon measuring the data in the subterranean well, and releasing the programmed untethered device into the subterranean well, such that the untethered device descends into the subterranean well. The steps may further include recovering the untethered device from the subterranean well after the untethered device changes its buoyancy and ascends in the subterranean well, and communicating and recording the data from the permanent sensors in the subterranean well during at least one of the descent of the untethered device and the ascent of the untethered device in the subterranean well. The steps may further include downloading the recorded data on an external processor.

According to at least one embodiment, the untethered device includes batteries and recharges the batteries of permanent downhole sensors by one of establishing a hard contact with sensor battery recharger circuit electrodes, inductively coupling to a sensor battery recharger circuit, capacitively coupling to the sensor battery recharger circuit, or near field magnetic resonance coupling to the sensor battery recharger circuit.

Figure 4:
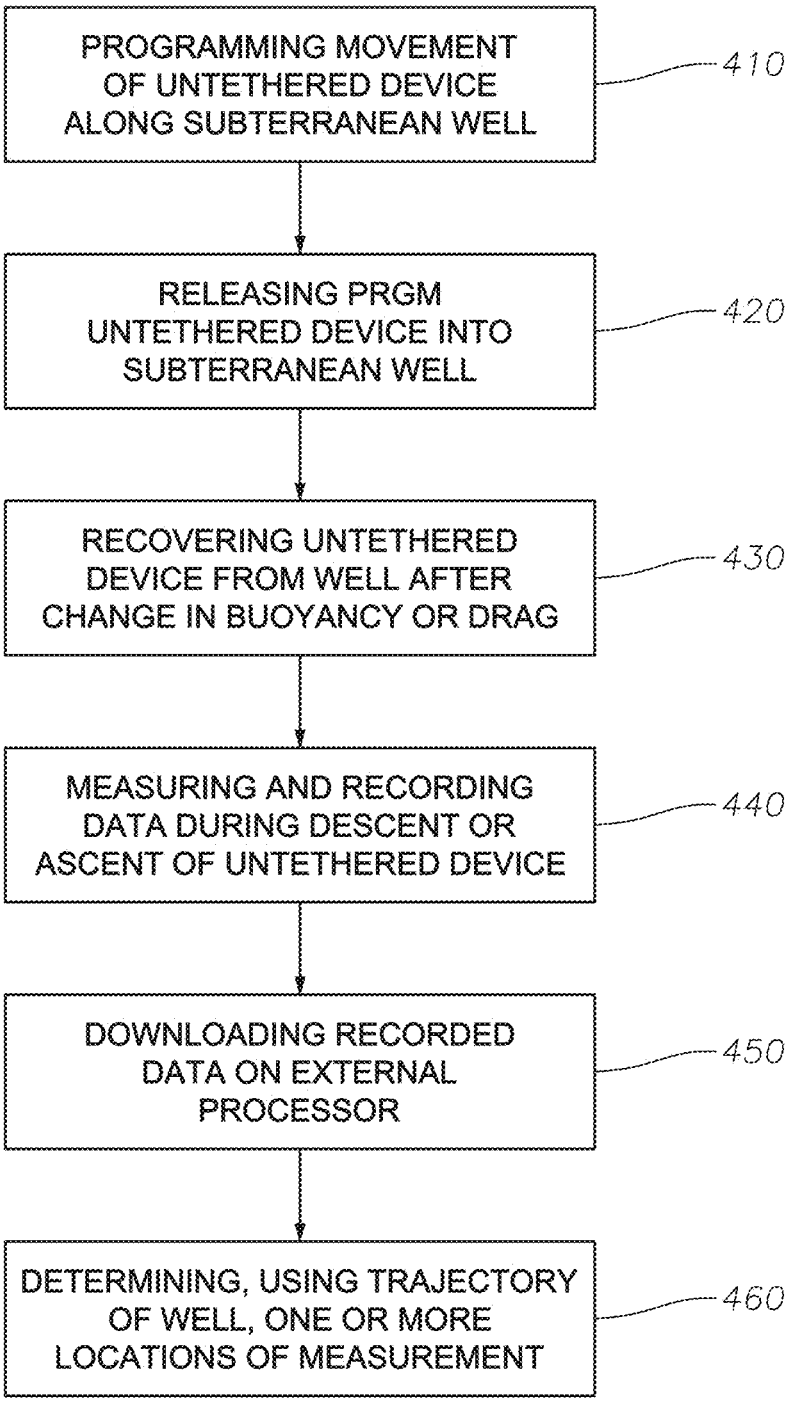
FIG. 4 shows a method for measuring properties along a subterranean well according to an embodiment of the invention.

FIG. 4 shows a method for measuring properties along a subterranean well. According to at least one embodiment, the method includes the steps of programming a movement of an untethered device along a subterranean well (step 410), wherein a position of the untethered device along the subterranean well is controlled by changing at least one of: a buoyancy of the untethered device and a drag of the untethered device upon measuring data in the subterranean well, the data comprising one of one or more physical, chemical, or structural properties in the subterranean well or the dynamics or position of the device in the subterranean well, and releasing the programmed untethered device into the subterranean well (step 420), such that the untethered device descends into the subterranean well. The method further includes the steps of recovering the untethered device from the subterranean well after the untethered device changes at least one of: the buoyancy and the drag and ascends in the subterranean well (step 430), and measuring and recording the data in the subterranean well during at least one of the descent of the untethered device and the ascent of the untethered device in the subterranean well (step 440). Further, the method includes the steps of downloading the recorded data on an external processor (step 450), and determining, using a trajectory of the well, one or more locations of the untethered device at which the data was measured (step 460).

Terms used herein are provided to explain embodiments, not limiting the present invention. Throughout this specification, the singular form includes the plural form unless the context clearly indicates otherwise. When terms "comprises" and/or "comprising" used herein do not preclude existence and addition of another component, step, operation and/or device, in addition to the above-mentioned component, step, operation and/or device.

Embodiments of the present invention may suitably comprise, consist or consist essentially of the elements disclosed and may be practiced in the absence of an element not disclosed. For example, it can be recognized by those skilled in the art that certain steps can be combined into a single step.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe the best method he or she knows for carrying out the invention.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

As used herein, the terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical or non-electrical manner. Objects described herein as being "adjacent to" each other may be in physical contact with each other, in close proximity to each other, or in the same general region or area as each other, as appropriate for the context in which the phrase is used. Occurrences of the phrase "according to an embodiment" herein do not necessarily all refer to the same embodiment.

Ranges may be expressed herein as from about one particular value, and/or to about another particular value. When such a range is expressed, it is to be understood that another embodiment is from the one particular value and/or to the other particular value, along with all combinations within said range.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

What is claimed is:

1. A method for operating an untethered tool in a well, the method comprising:

releasing the untethered tool, wherein the untethered tool comprises: a housing, and a changeable ballast attached to the housing and configured to control buoyancy of the untethered tool;

wherein releasing the untethered tool comprises:

closing a master valve of a Christmas tree assembly associated with the well;

opening a swab valve of the Christmas tree assembly;

introducing the untethered tool into the well through the swab valve;

closing the swab valve;

opening the master valve; and recovering the untethered tool at the Christmas tree assembly after a period during which the untethered tool has descended into the well, modified the changeable ballast, and ascended up the well, wherein controlling the buoyancy using the changeable ballast of the untethered tool comprises using a switching device of the untethered tool to release a weight attached to the untethered tool, wherein the switching device is a magnetic flux switching device comprising a first permanent magnet and a second permanent magnet, the first permanent magnet and the second permanent magnet connected in parallel, the first permanent magnet having a greater coercivity than that of the second permanent magnet, wherein a coil of wire is wrapped around the second permanent magnet so to polarize the second permanent magnet upon an electrical current being reversibly applied to the coil of wire such that the weight is selectively secured and released from the untethered tool.

2. The method of claim 1, wherein recovering the untethered tool comprises:

closing the master valve;

opening the swab valve; and retrieving the untethered tool through the swab valve.

3. The method of claim 1, wherein recovering the untethered tool further comprises:

opening a production wing valve of the Christmas tree assembly to allow the flow of fluids moving through the Christmas tree assembly.

4. The method of claim 1, wherein the changeable ballast is selected from a group consisting of: a dissolvable ballast, and a releasable ballast.

5. The method of claim 1, the method further comprising:

disposing a sensor at the well;

sensing, by the sensor, an output signal generated by the untethered tool; and determining, using the output signal, a location of the untethered tool within the Christmas tree assembly.

6. The method of claim 5, wherein the untethered tool comprises an acoustic signal generator, wherein the sensor is an acoustic sensor, and wherein the output signal is generated by the acoustic signal generator.

7. The method of claim 6, wherein the acoustic signal generator is further configured to generate an acoustic signal for determining a characteristic of the well.

8. The method of claim 7, wherein recovering the untethered tool comprises:

based at least in part on sensing the untethered tool in the Christmas tree assembly:

closing the master valve;

closing a production arm valve;

opening the swab valve; and retrieving the untethered tool through the swab valve.

9. The method of claim 1, wherein the Christmas tree assembly comprises a screening element configured to allow fluids from the well to pass but to preclude passage of the untethered tool.

10. A method for operating an untethered tool in a well, the method comprising:

releasing the untethered tool, wherein the untethered tool comprises: a housing having an interior portion, a signal generator disposed in the housing, and a changeable ballast attached to the housing and configured to control buoyancy of the untethered tool, and wherein releasing the untethered tool comprises:

closing a master valve of a Christmas tree assembly associated with the well;

opening a swab valve of the Christmas tree assembly;

introducing the untethered tool into the well through the swab valve;

closing the swab valve;

opening the master valve;

wherein the Christmas tree assembly comprises a screening element configured to allow fluids from the well to pass but to preclude passage of the untethered tool; and deploying a sensor at the well, wherein the sensor is configured to:

sense an output signal within the Christmas tree assembly, wherein the output signal is generated by the signal generator of the untethered tool; and provide a sensor output; and recovering the untethered tool after a period during which the untethered tool has descended into the well, modified the changeable ballast, and ascended up the well; wherein recovering the untethered tool comprises determining, based at least in part on sensing the output signal, that the untethered tool is within the Christmas tree assembly, wherein controlling the buoyancy using the changeable ballast of the untethered tool comprises using a switching device of the untethered tool to release a weight attached to the untethered tool, wherein the switching device is a magnetic flux switching device comprising a first permanent magnet and a second permanent magnet, the first permanent magnet and the second permanent magnet connected in parallel, the first permanent magnet having a greater coercivity than that of the second permanent magnet, wherein a coil of wire is wrapped around the second permanent magnet so to polarize the second permanent magnet upon an electrical current being reversibly applied to the coil of wire such that the weight is selectively secured and released from the untethered tool.

11. The method of claim 10, wherein the sensor is an acoustic sensor, and wherein the signal generator is an acoustic signal generator.

12. The method of claim 10, the method further comprising:

disposing a sensor at the well;

sensing, by the sensor, an output signal generated by the untethered tool; and determining, using the output signal, a location of the untethered tool within the Christmas tree assembly.

13. The method of claim 12, wherein recovering the untethered tool comprises:

based at least in part on sensing the untethered tool in the Christmas tree assembly:

closing the master valve;

closing a production arm valve;

opening the swab valve; and retrieving the untethered tool through the swab valve.

14. An untethered tool for use in investigating a well, the untethered tool comprising:

a chemical sensor configured to sense a chemical characteristic within the well;

a physical sensor configured to sense a physical characteristic within the well; and a drag element configured to modify a position of the untethered tool within the well by using drag as the untethered tool moves within a material in the well; and a buoyancy element configured to modify a position of the untethered tool within the well by using buoyancy of the buoyancy element in the material in the well, wherein the buoyancy element comprises a changeable ballast including a switching device of the untethered tool configured to release a weight attached to the untethered tool, wherein the switching device is a magnetic flux switching device comprising a first permanent magnet and a second permanent magnet, the first permanent magnet and the second permanent magnet connected in parallel, the first permanent magnet having a greater coercivity than that of the second permanent magnet, wherein a coil of wire is wrapped around the second permanent magnet so to polarize the second permanent magnet upon an electrical current being reversibly applied to the coil of wire such that the weight is selectively secured and released from the untethered tool.

15. The method of claim 9, wherein after the period during which the untethered tool has descended into the well, modified the changeable ballast, and ascended up the well, the untethered tool is trapped by the screening element between the master valve and the swab valve.

16. The method of claim 9, wherein the screening element is selected from a group consisting of: a screen, and a pipe section comprising slits positioned in a flow of fluids moving through the Christmas tree assembly.

* * * * *